United States Patent [19]

Tokui et al.

[11] Patent Number: 4,505,318

[45] Date of Patent: Mar. 19, 1985

[54] VERTICAL TYPE PRESSURE CASTING METHOD

[75] Inventors: Masaaki Tokui; Toshika Masaoka; Atsushi Ota, all of Toyota, Japan

[73] Assignee: Toyoto Jidosha Kogyo Kabushiki Kaisha, Toyota, Japan

[21] Appl. No.: 384,949

[22] Filed: Jun. 4, 1982

[51] Int. Cl.[3] ..... B22D 17/00

[52] U.S. Cl. ..... 164/113; 164/313

[58] Field of Search ..... 164/113, 119, 120, 313, 164/319, 321

[56] References Cited

FOREIGN PATENT DOCUMENTS 0079728 7/1978 Japan ..... 164/113

0036369 4/1981 Japan ..... 164/313

*Primary Examiner*—Kuang Y. Lin

*Attorney, Agent, or Firm*—Oblon, Fisher, Spivak, McClelland & Maier

[57] ABSTRACT

A method of casting including the steps of closing gates with a counter tip after lower and upper molds heated to a predetermined temperature have been clamped, pouring melt into a sleeve in which a plunger tip is lifted a predetermined distance, lowering the plunger tip while displacing the counter tip to a predetermined position to open the gates, which are formed such that the ratio of the volume of products to the cross-sectional area of the gates is 20–40 (i.e. the volume of products/($CM^3$) cross-sectional area of gates ($CM^2$)=20–40), to allow the melt to flow into cavities via the gates by the force of gravity alone with the plunger tip reaching the upper surface of the melt the moment a percentage of the melt placed in the cavities has reached a value between 30 and 70%, and pressure-filling the cavities with the melt by the plunger tip with the melt passing through the gates at 0.4–0.8 m/sec.

3 Claims, 6 Drawing Figures

VERTICAL TYPE PRESSURE CASTING METHOD

BACKGROUND OF THE INVENTION

FIELD OF THE INVENTION

The present invention relates to a vertical type pressure casting method used for accurately casting aluminum alloy products, comprising the steps of closing gates communicating with the cavities of clamped molds with a counter-tip, pouring melt into the portion of the interior of a sleeve which is between the counter-tip and a lifted plunger tip, displacing the counter-tip to open the gates and allow the melt to flow into the cavities by the force of gravity, and thereafter pressure-filling the cavities with the melt using the plunger tip. More particularly, the present invention concerns a vertical type pressure casting method comprising the steps of first lowering a plunger tip, subsequently displacing a counter-tip before the plunger tip reaches the melt in the sleeve to open the gates to the cavities and allow the melt to flow into the cavities by the force of gravity, and thereafter pressurizing the melt to fill the cavities, the melt being thus injected into the cavities smoothly and continuously at a low rate to prevent gas from being sucked therein, the cross-sectional area of the gates being set so that the ratio of the volume of the products to the cross-sectional area of the gates is 20–40 (volume of products ($cm^3$)/ cross-sectional area of gates ($cm^2$)=20–40), the speed of the plunger tip and the length of time between commencing the downward movement of the plunger tip and opening the gates being set to an optimum level determined in relation to the temperatures of the molds and melt, a percentage of the melt to be fed into the cavities by the force of gravity at the time when the plunger tip reaches the melt in the sleeve being set to 30–70, if the plunger tip does not move the percentage of the melt which is to flow into the cavities by the force of gravity alone being set to not less than 30%, the speed of the melt through the gates when pressure filling the cavities with the plunger tip being set to 0.4–0.8 m/sec.

DESCRIPTION OF THE PRIOR ART

As is generally known, there are various kinds of cast products. Among these, cast products of a light alloy such as aluminum alloy have generally been manufactured by gravity casting, low-pressure casting and pressure die casting.

However, because of the following problems, these casting methods do not yield high quality cast products and the productivity cannot be improved.

In gravity casting and low-pressure casting, the melt is not forcibly pressurized, so that so-called shrinkage holes occur in it in the solidifying step. Consequently, sound products cannot be obtained. Moreover, the solidifying rate in these casting methods is low, decreasing the productivity.

In pressure die casting, the sleeve-charging percentage is 50–70, and, moreover, the melt is introduced under pressure at a high rate. Accordingly, the gas in certain portions of the passage for the melt, such as gates, and in the cavities is liable to mix with the melt, decreasing the reliability of the quality of the products.

With a view to eliminating the above-mentioned inconveniences, a vertical type die casting method has been developed which has a sleeve-charging percentage of 100 and in which the melt is pressurized without mixing with gas in the gates and cavities. However, the casting method also has some problems which have not yet been completely solved with respect to soft materials for obtaining high-quality products, namely the casting conditions and a casting program in relation to the casting mechanism. Thus, the advantages of this casting method cannot be utilized effectively.

SUMMARY OF THE INVENTION

An object of the present invention is to provide an excellent vertical type pressure casting method, which has been developed in view of the problems with the above-mentioned vertical type casting method, which was developed to supersede the existing casting method using metal molds, and which has various advantages but does not give full play to its functions. The casting conditions include the speed of the plunger and the temperatures of the molds and melt, and the design conditions include the percentage of melt to be introduced into cavities by the force of gravity, and the cross-sectional area of gates in the method according to the present invention being set to levels in optimum ranges with respect to one another, whereby highly reliable high-quality products can be cast.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

An embodiment of the present invention will now be described with reference to the accompanying drawings.

Figure 1:
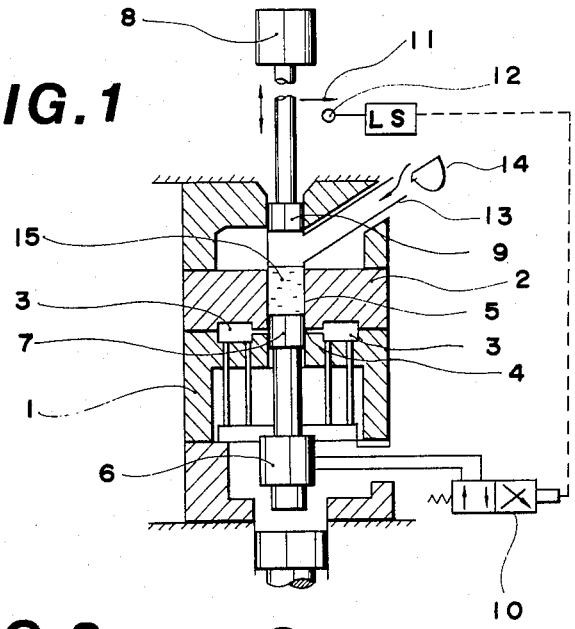
FIG. 1 is a schematic diagram of a vertical type pressure casting apparatus.

FIG. 1 shows a vertical type pressure casting apparatus used in the method according to the present invention. A lower mold 1 and an upper mold 2 are clamped together to form cavities 3, 3. Gates 4 for the cavities, 3, 3 face the interior of a sleeve 5. A counter-tip 7 connected to a hydraulic cylinder 6, and a plunger tip 9 connected to a hydraulic cylinder 8 are provided opposing each other in lower and upper positions, respectively, in the sleeve 5 such that the counter-tip 7 and plunger tip 9 can be moved up and down therein. A solenoid in a change-over valve 10 connected to hydraulic cylinder 6 is controlled by a limit switch 12 operatively associated with respect to a dog provided on a rod portion of plunger tip 9.

The melt 15 is poured from a melt inlet port 13 into the sleeve 5 by a ladle 14.

The above apparatus is designed so that the ratio of the volume ($cm^3$) of the product to the cross-sectional area ($cm^2$) of the gates 4, which is one of the construction parameters of the apparatus, is 20–40.

The operational conditions and program for the present invention to be practiced by using the apparatus of this construction are set to attain the following: The plunger tip 9 is moved downward to lower the counter-tip 7 through the dog 11 and limit switch 12. The relation between the speed V m/sec at which the plunger tip 9 moves downward and the length of time (T sec) from the commencement of the downward movement of the plunger tip 9 to the opening of the gates 4 by the counter tip 7, is set to an optimal value with reference to the information shown in FIG. 5. Namely, the speed, at which the plunger tip 9 moves down is set to a level between the upper limit level in an upper limit speed curve $R_1$, above which the plunger tip 9 moves down too fast and reaches the upper surface of the melt 15 in the sleeve 5 to start the pressure-filling operation before the gates 4 have been opened by the counter tip 7, and a lower limit level in a lower limit speed curve $R_2$, below which the plunger tip 9 reaches the upper surface of the melt 15 in the sleeve 5 after the gates 4 have been fully opened by the counter tip 7 allowing the melt 15 to flow into the cavities by the force of gravity until the flow of melt has stopped, whereby the melt 15 can be fed to the cavities 3, 3 smoothly and continuously at a low rate.

Figure 5:
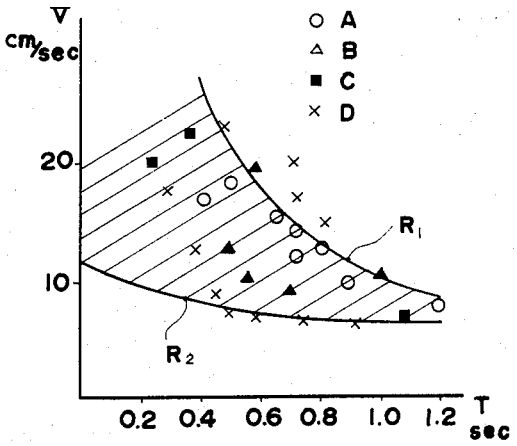
FIG. 5 is a diagram illustrating the relationship between the speed of downward movement of the plunger tip and the length of a period of time from the commencement of downward movement of the plunger unit and the opening of the gates by a counter-tip.

According to the experimental results, the percentage distribution of acceptable cast products with respect to the whole number of cast products obtained under different conditions is as shown in the data in FIG. 5.

A: not less than 90%. B: 50–90%. C: 20–50%. D: not more than 20%.

This relation between the speed of the plunger tip 9 and the length of a period of time between T the commencement of the downward movement of the plunger and the opening of the gates can also be set differently by varying not only the cross-sectional area of the gates but also the temperatures of the molds and melt.

After the cross-sectional area of the gates and the temperatures of the molds and melt have been determined, the percentage of the melt to be fed into the cavities by the force of gravity at the time when the plunger tip 9 reaches the upper surface of the melt 15 in the sleeve 5 is set to 30–70, and the speed of the melt through the gates during the feeding of the melt to the cavities by the force of gravity to not less than 0.1 m/sec with the speed of the melt through the gates when pressure-filling the cavities using the plunger tip 9 set to 0.4–0.8 m/sec.

The molds are clamped as shown in FIG. 1 with the casting apparatus set in accordance with the above-mentioned casting conditions and program, and the hydraulic cylinder 6 is actuated to close the gates 4 with the counter-tip 4. The hydraulic cylinder 8 is then actuated to set the plunger tip 9 to an initial attitude position.

A predetermined amount of melt 15 is then poured from a melt inlet port 13 into the sleeve 5, and a button for a control unit (not shown) is pressed to actuate the hydraulic cylinder 8 to start the casting operation in accordance with the casting conditions and program referred to above.

Figure 2:
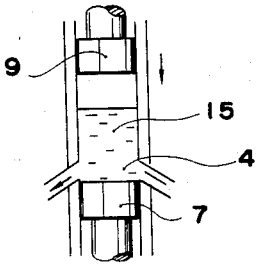
FIGS. 2, 3 and 4 illustrate the process for pouring the melt through gates into cavities.
Figure 3:
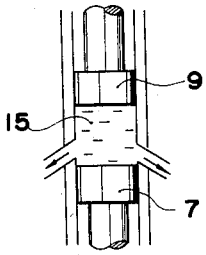

First, when the plunger 9 starts being moved downward at a predetermined speed with the dog 11 coming into contact with the limit switch 12, the counter-tip 7 is moved downward at a predetermined point in time by operation of the change-over valve 10 before the plunger tip 9 has reached the upper surface of the melt 15 in the sleeve 5 as shown in FIG. 2, in accordance with the relation between the set speed and time shown in FIG. 5, to open the gates 4. The melt 15 then starts flowing from the gates 4 into the cavities 3 by the force of gravity.

After a predetermined period of time has passed, the plunger tip 9 reaches the upper surface of the melt 15 (which is, of course, flowing into the cavities by the force of gravity) in the sleeve 5. At this time, the percentage of the melt placed in the cavities is 30–70 as mentioned above.

Figure 4:
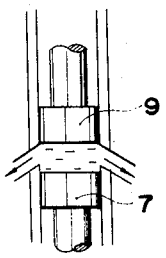

The melt-feeding by the force of gravity is then changed to pressure-filling as shown in FIG. 4. The speed of the melt through the gates during pressure-filling by the plunger tip 9 is set to 0.4–0.8 m/sec as mentioned above.

Thus, in the casting operation as a whole according to the present invention, the melt 15 in the sleeve 5 is fed into the cavities by its own weight, i.e. by the force of gravity, in the initial stage, and under pressure by the plunger tip 9 before the gravity-feeding operation has finished. Since this casting operation is conducted in accordance with the above-mentioned numerically limited conditions and program, the melt 15 fills the cavities 3 relative smoothly and continuously at a low rate without permitting gas to enter the melt.

When the ratio of the volume of products at the gates 4 to the cross-sectional area of the gates is less than 20, the melt flows into the cavities by its own weight too quickly, or the gravity-feeding time becomes too short, so that the optimum range is narrow. When this ratio exceeds 40, the injection of the melt into the cavities by the force of gravity progresses too slowly, and the percentage of melt put in the cavities by the force of gravity becomes low, so that the melt which has passed through the gates is disordered, causing gas to mix the melt and cold shut to occur.

When a point representing the relation between the speed of the plunger tip 9 and the length of the period of time between the commencement of a downward movement of the plunger tip 9 and the opening of the gates by the countertip 7 is above the maximum speed curve shown in FIG. 5, the pressure-filling operation starts too early as mentioned before. When this point is below the minimum speed curve, the flow of the melt by the force of gravity stop before the pressure-filling operation start. Either of these cases yields defective cast products.

When a gravity-feeding operation is shifted to a pressure-filling operation, the melt should be placed in the cavities relative smoothly, without disturbance, at a low rate, and in a continuous manner. When the percentage of the melt which flows into the cavity by the force of gravity, a gravity-feeding percentage, is lower than 30, the pressure-filling operation starts too early. When this percentage exceeds 70, the gravity-feeding operation is carried out excessively. Therefore, in either of these cases, the gravity-feeding operation cannot be shifted to the pressure-filling operation immediately and smoothly, so that gas mix and the melt and cold shut occurs.

When this casting apparatus is designed so that a pressure-filling operation is not conducted during a gravity-feeding operation only, i.e. the melt flows into the cavities by only the force of gravity, a percentage of melt to be placed in the cavities by the force of gravity is set to at least 30 and then pressure filling is conducted supplementarily. When the percentage of melt to be placed in the cavities by the force of gravity is set in this manner, gas can be prevented from entering the products.

Consequently, when the casting apparatus is designed so that the percentage of melt to flow into the cavities by the force of gravity only is below 30, the pressure-filling operation is conducted excessively. In this case, no optimum range of casting conditions is available.

When the speed of the melt through the gates during the pressure-filling operation is below 0.4 m/sec, the melt does not flow in a satisfactory manner, and when this speed exceeds 0.8 m/sec, a gas enters the melt.

Figure 6:
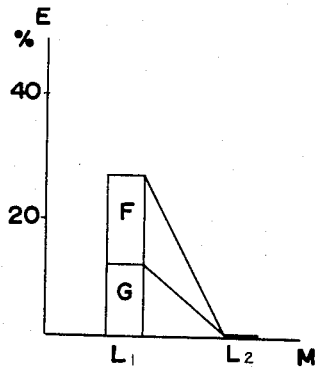
FIG. 6 is a graph showing percentages of inferior products in the present embodiment and in a conventional method.

A comparison between the results in different modes M of casting methods, namely a conventional method $L_1$ of die casting and a method $L_2$ used in an experiment conducted in accordance with the above embodiment of the present invention, the percentage E of inferior products, especially, a percentage F of inferior products due to the leakage of pressure and a percentage G of inferior products which fail to pass an X-ray inspection, shows as is clear from FIG. 6 that the percentages F, G in the method $L_1$ are far higher than those in the method $L_2$, the casting method according to the present invention permits obtaining extremely good products.

As described above, by the present invention faultless products which have basically high quality can be manufactured, and it has an excellent effect.

Moreover, the casting conditions and program can be set or determined easily, and the time and cost for conducting experiments and modifying the metal molds can be reduced to a remarkable extent.

Since the gates are formed in such a manner that a ratio of the volume of products to a cross-sectional area of the gates is 20–40, gas does not mix in the melt and no cold shut occurs. Therefore, faultless products can be obtained.

The speed at which the plunger tip is moved down until the counter-tip is displaced to open the gates is set to an optimum level which makes the plunger tip reach the upper surface of the melt in the sleeve between the time the melt starts flowing into the cavities by the force of gravity, and the time, at which the gravity-feeding of the melt is finished. Accordingly, a very high percentage of satisfactory products can be obtained.

When the casting program, in which a percentage of the melt to be placed in the cavities by the force of gravity only is set to be not less than 30%, is prepared experimentally such that the percentage of the melt to flow into the cavities by the force of gravity at the time when the plunger tip reaches the upper surface of the melt in the sleeve is 20–70, the operation for feeding the melt into the cavities by the force of gravity can be shifted relative smoothly, without disturbance, at a low rate and in a continuous manner to an operation for pressure-filling the cavities therewith. This allows faultless products to be obtained.

Since the speed of the melt through the gates during the pressure-filling operation is set to 0.4–0.8 m/sec, gas does not enter the cavities, and the melt can be put in the cavities in a desired manner as mentioned above.

Obviously, numerous modifications and variations of the present invention are possible in light of the above teachings. It is therefore to be understood that within the scope of the appended claims, the invention may be practiced otherwise than as specifically described herein.

What is claimed is:

1. A vertical type pressure casting method utilizing a mold with a first and second mold member, at least one cavity formed in the mold, at least one sleeve portion formed in the mold, a movable plunger movable within said sleeve and having a tip, a counter-tip movable within said sleeve and gate means interconnecting said at least one cavity and said sleeve, which comprises:

clamping said first and second mold members together to form said mold;

closing said gate means with said counter-tip;

pouring a melt into said sleeve with said plunger tip being located in said sleeve in a lifted state;

displacing said counter-tip and opening said gate means so as to allow the melt to flow into said at least one cavity via said gate means by force of gravity;

pressurizing the melt in said sleeve by moving said plunger tip downward to fill said cavities with said melt wherein said displacing of said counter-tip and opening of said gate means further comprises opening said gate means by said counter-tip after said plunger has started moving downward; and controlling the speed of said plunger tip during the period of time from commencement of downward movement thereof to opening of said gate means to a level between an upper limit level in an upper limit speed curve above which said plunger tip moves down too fast and reaches an upper surface of the melt in said sleeve to start a pressure-filling operation before said gate means has been opened by said counter-tip, and a lower limit level in a lower limit speed curve below which said plunger tip reaches the upper surface of said melt in said sleeve after said gate means has been fully opened by said counter-tip allowing said melt to flow into said at least one cavity by the force of gravity alone until the flow of said melt has stopped so as to control the rate of flow of melt into said at least one cavity in such a manner that a ratio of the volume of products to the cross-sectional area of said gate means is 20–40 such that the percentage of melt flowing into said at least one cavity by the force of gravity alone is not less than 30 percent, the percentage of melt fed into said at least one cavity by the force of gravity at a time when said plunger tip reaches the melt in said sleeve is 30–70 percent, and the speed of melt flowing through said at least one gate during the pressure-filling of said at least one cavity by said plunger tip is 0.4–0.8 m/sec.

2. A vertical type pressure casting method according to claim 1 which further comprises controlling the speed of flow of the melt through the gate means during feeding of the melt into said at least one cavity by the force of gravity so as to be not less than 0.1 m/sec.

3. A vertical type pressure casting method utilizing a mold with a first and second mold member, at least one cavity formed in the mold, at least one sleeve portion formed in the mold, a movable plunger movable within said sleeve and having a tip, a counter-tip movable within said sleeve, and gate means interconnecting said at least one cavity and said sleeve, which comprises:

clamping said first and second mold members together to form said mold;

closing said gate means with said counter-tip;

pouring a melt into said sleeve with said plunger tip being located in said sleeve in a lifted state;

displacing said counter-tip and opening said gate means so as to allow the melt to flow into said at least one cavity via said gate means by the force of gravity;

pressurizing the melt in said sleeve by moving said plunger tip downward to fill said cavities with said melt wherein said displacing of said counter-tip and opening of said gate means further comprises opening said gate means by said counter-tip after said plunger has started moving downward;

controlling the speed of said plunger tip during the period of time from commencement of downward movement thereof to opening of said gate means to a level between an upper limit level in an upper limit speed curve above which said plunger tip moves down too fast and reaches an upper surface of the melt in said sleeve to start a pressure-filling operation before said gate means has been opened by said counter-tip, and a lower limit level in a lower limit speed curve below which said plunger tip reaches the upper surface of said melt in said sleeve after said gate means has been fully opened by said counter-tip allowing said melt to flow into said at least one cavity by the force of gravity alone until the flow of said melt has stopped; and controlling the rate of flow of melt into said at least one cavity in such a manner that the ratio of the volume of products to the cross-sectional area of said gate means is 20–40; not less than 30 percent of the melt flows into said at least one cavity by the force of gravity alone; the percentage of the melt fed into the at least one cavity by the force of gravity at the time when the plunger tip reaches said upper surface of the melt in said sleeve is 30–70 percent; and the speed of the melt through the gate means during the pressure-filling of said cavities with the plunger tip is set to 0.4–0.8 m/sec.

* * * * *